United States Patent [19]

Satou et al.

[11] 4,175,652

[45] Nov. 27, 1979

[54] ESCALATOR WITH STEP LEVELERS

[75] Inventors: Yoshihiko Satou; Katsuya Teranishi, both of Katsuta, Japan

[73] Assignee: Hitachi, Ltd., Japan

[21] Appl. No.: 753,886

[22] Filed: Dec. 23, 1976

[30] Foreign Application Priority Data

Dec. 29, 1975 [JP] Japan ..... 50-155987

[51] Int. Cl.[2] ..... B66B 9/12

[52] U.S. Cl. ..... 198//332; 104/248

[58] Field of Search ..... 198/332, 326; 104/248, 104/34

[56] References Cited

U.S. PATENT DOCUMENTS

| | | | |
|---|---|---|---|
| 570,746 | 11/1896 | Curtis et al. | 104/248 |
| 805,214 | 11/1905 | Lowry et al. | 104/248 |
| 1,197,260 | 9/1916 | Brown | 104/248 |
| 2,254,607 | 9/1941 | Guerrero | 104/248 |
| 2,686,585 | 8/1954 | Margles et al. | 198/332 |

FOREIGN PATENT DOCUMENTS

| | | | |
|---|---|---|---|
| 823917 | 9/1969 | Canada | 104/34 |

*Primary Examiner*—Robert B. Reeves
*Assistant Examiner*—Douglas D. Watts
*Attorney, Agent, or Firm*—Craig and Antonelli

[57] ABSTRACT

An escalator comprising steps linked in an endless belt, front wheels and rear wheels for each of the steps supporting the step through a front shaft and a rear shaft respectively, guide rails for guiding the rolling movement of the front and rear wheels respectively, and projections extending axially of the rear shaft for each of the steps and projection upthrust rails mounted in a rear wheel portion of each of the steps, each of the projection upthrust rails being arranged in a manner to be juxtaposed against one of the projections and adapted to be brought into engagement with the projection to prevent an inadvertent pivotal upward movement of the step when this tendency occurs, whereby the accident of the shoes of passengers and other objects being caught in a riser portion of the step due to an inadvertent pivotal upward movement of the step can be avoided.

9 Claims, 9 Drawing Figures

ESCALATOR WITH STEP LEVELERS

This invention relates to escalators in general, and more particularly to an escalator of the type which is provided with means for preventing an inadvertent pivotal upward movement of steps of an escalator.

It is well known that an escalator comprises steps linked in an endless belt and traveling in a loop, such steps being positioned relative to each other such that, in order that the passengers can utilize the escalator in safety, there is no difference in height between the surfaces of the treads of the adjacent steps in the entrance and exit of the escalator at both ends thereof at floors of different levels but the difference in height between the surfaces of the adjacent steps gradually increases as they move away from the entrance or exit of the escalator, until there is a predetermined difference in height between the surfaces of the steps when they are traveling in an intermediate section of the escalator.

If a passenger has his or her shoes pressing against a riser portion of a step during the time the difference in height between the surfaces of the adjacent steps is gradually decreasing or while the steps are traveling from the intermediate section of the escalator toward the exit thereof at a floor of a higher level or while the steps are traveling from the intermediate section of the escalator toward the exit thereof at a floor of a lower level, a problem arises in which the difference in height between the adjacent steps is kept from decreasing due to the frictional dragging of the shoes on the riser portion, with the result that the riser side of one of the two adjacent steps inadvertently pivotally moves upwardly and the shoes are caught in the riser portion. This accident will be described in detail with reference to an example in which the passengers are moving upwardly in an escalator.

As is well known, an escalator comprises a frame supporting the entire structure, a pair of railings, an end portion disposed at a floor of a lower level serving as an entrance or exit of the passengers, an end portion disposed at a floor of a higher level serving as an exit or entrance thereof, comb plates disposed in the end portions at the floors of different levels for scooping up the passengers, and steps linked in an endless belt to transport the passengers by traveling in a loop. Each of the steps comprises a step portion and a riser portion and is supported by front wheels and rear wheels. The front and rear wheels move in rolling motion over front and rear wheel guide rails respectively, and the steps travel upwardly or downwardly while the surfaces of the adjacent steps are maintained at different levels.

As aforementioned, as the steps move from the intermediate section of the escalator to the exit thereof at a floor of a higher level, the front and rear wheel guide rails gradually become curved as contrasted to their linear section in the intermediate section of the escalator, and finally the guide rails become straight again in a horizontal position at the exit. In this case, the difference in height between the surfaces of the adjacent steps gradually decreases until the difference becomes zero or the surfaces of the adjacent two steps become flush with each other at the exit of the escalator. If, during the time in which the height between the surfaces of the adjacent steps is decreasing in a section of the escalator in which the front and rear wheel guide rails are curved, a passenger has his or her shoes pressing strongly against the riser portion of the step preceding the step on which the passenger stands, the shoes will be locked to the riser by the frictional dragging of the shoes on the riser portion, thereby interfering with the automatic movement of the steps to reduce the difference in height between their surfaces. Even if such condition is brought about, the front wheels which pull the step normally operate, so that the locked riser portion of the tread of the step gradually moves upwardly in pivotal motion about the center of the front wheels. The amount of this pivotal upward movement increases with the traveling of the step until the leading end of the tread of the step made to incline by the inadvertent pivotal upward movement abuts against the riser portion of the preceding step and further upward movement is prevented. Then the riser of the step which has been pivotally moved upwardly by the locking action of the shoes is forcedly moved downwardly.

On the other hand, when a step inadvertently moves pivotally upwardly due to the locking of the riser portion by the shoes of a passenger or other objects, a gap between the adjacent steps increases in size due to the upward movement of one of the steps. This is because the inadvertent pivotal upward movement of the step is caused by its movement about the center of its front wheels, while the riser curves about the leading end of the tread of the step. Thus, as the amount of inadvertent pivotal upward movement of the step increases, the size of the gap between the riser and the front surface of the following step increases in proportion thereto.

As aforesaid, if a passenger has his or her shoes or other objects strongly pressing against the riser portion of a step, the riser portion inadvertently moves pivotally upwardly and consequently the size of a gap between the riser and the front surface of the following step increases until the pivotal upward movement of the riser portion above a predetermined level is prevented by the influence of the preceding step. This results in the upwardly moved riser portion being forcedly moved downwardly. Thus, there is the hazard of the locked shoes or other objects being caught in the gap between the riser and the front surface of the following step whose size is increased in this way. There have hitherto been accidents involving the shoes and hence the feet of passengers being caught in such gap and crushed between the steps or transported to the exit of the escalator where they are penetrated by the teeth of the comb plate.

In order to prevent such accidents, it has been considered necessary to minimize the amount of an inadvertent pivotal upward movement of each of the steps and to minimize an increase in the size of a gap between the adjacent steps in a section of the escalator wherein the difference in height between the surfaces of the adjacent steps decreases or the front and rear wheel guide rails are curved. To this end, it has been usual practice to provide rear wheel upthrust rails which are located above the rear wheels of the steps in uniformly spaced relation to thereby prevent pivotal upward movement of the steps. By providing the rear wheel upthrust rails, it was expected that the gap between the adjacent steps would not appreciably vary and, therefore the accident of the shoes of a passenger or other objects being caught in the riser portion of a step could be prevented. It was also expected that, even if the shoes were caught in the riser portion, the portions of the shoes involved would be small in size and no injury would be caused to human bodies.

However, a problem has arisen in regard to the impossibility of providing the rear wheel upthrust rails to the entire section of the escalator in which the front and rear wheel guide rails are curved, because of the position in which they are mounted and due to the relative dimensions of the rear wheel upthrust rails and the steps which travel. In order to avoid using no more space than is necessary, it is usual practice to arrange the front and rear wheels such that their power transmitting surfaces are coplanar in a section of the escalator in which the rear and front guide rails are linear. Even if there is a difference in their planes, the difference is minute. Because of this, the spacing between the power transmitting surface of each of the rear wheels and the front shaft of the same step is smaller than the outer diameter of the rear wheel in the section of the escalator in which the front and rear wheel guide rails are linear. Thus, if the rear wheel upthrust rails are mounted above the rear wheels, the front shafts have been found to abut against the upthrust rails. In view of this, it has been impossible to mount the rear wheel upthrust rails in sections other than the section in which the front and rear wheel guide rails are curved and the spacing between the front shaft and the rear wheel is gradually increasing or unless there is a large spacing between the rear wheels and the front shaft of a step. It has thus been impossible to mount the rear wheel upthrust rails in about half the length of the escalator in which the rear wheel guide rails are curved. Therefore, the use of the rear wheel guide rails has given rise to the problem that, if shoes or other objects are pressed strongly against the riser portion of a step in a section of the escalator in which the front and rear wheel guide rails change from a linear to a curved condition and the rear wheels of the step reach the position wherein the rear wheel guide rails are provided or in which the difference in height between the surfaces of the steps begins to decrease, the shoes or other objects will be caught in an increased gap between the adjacent steps. The situation is aggravated by the facts that the shoes or other objects will be rapidly crushed when the rear wheels are forcedly pulled into the rear wheel upthrust rails, and that the gap between the riser and the front surface of the following step is forcedly reduced as the result of the rear wheels being pushed down to the rear wheel upthrust rails, so that in some cases it becomes impossible to withdraw the shoes or other objects from the gap and the same are pierced by the comb plate at the exit end of the escalator at the higher level, causing serious injury to the passenger.

The practice of providing rear wheel upthrust rails has the aforementioned disadvantages. In order to completely eliminate the accidents of having the shoes or other objects caught in a gap between the riser and the front surface of the following step, it is necessary to provide means whereby pivotal upward movement of each of the steps can be prevented in the entire section of the escalator in which the front and rear wheel guide rails are curved. To this end, proposals have been made to mount a pawl means on the rear shaft of each of the steps which pawl means is engageable with a pawl means upthrust rail mounted in the frame and spaced apart a predetermined distance from the pawl means. This solution has an advantage in that it is possible to prevent inadvertent pivotal upward movement of a step in the entire section of the escalator in which the difference in height occurs between the surfaces of the steps, since the pawl means upthrust rail is not brought into contact with anything that travels, even if the front and rear wheel guide rails are linear. However, the need to mount the pawl means on the rear shafts and the pawl means upthrust rail in a small space defined by the frame makes it necessary to reduce the thickness of pawls of the pawl means. Thus there is the disadvantage of the pawl means being low in strength in case of emergency. Moreover, if any one of the rear wheels or the rubber tire on the surface of any one of the rear wheels is dislodged from its position and the step involved is slightly inclined, the pawl means will strike the frame and will be broken or bent. In another solution of the problem known in the art, such pawl means is mounted on each of the steps or formed integrally with one of the steps. Even in such case, since there is a slender projection extending locally from each step, there is the disadvantage of a variation in size occurring in the pawl means mounted in all the steps, and it is necessary to provide a considerably large clearance between the pawl means and the pawl means upthrust rail. One of the problem encountered in this mechanism is that it is impossible to minimize the amount of pivotal upward movement of the steps.

This invention has as its object the provision of an escalator which is provided with means for effectively preventing the accident of shoes or other objects being caught in a riser portion of a step due to an inadvertent pivotal upward movement of the step.

According to the invention, there is provided an escalator comprising steps linked in an endless belt, front wheel and rear wheels for each of the steps supporting the step through a front shaft and a rear shaft respectively, guide rails for guiding the front wheels and rear wheels respectively in their rolling movement, projections extending axially of the rear shaft for each step, and projection upthrust rails each being arranged in a manner to be juxtaposed against one of the projections and adapted to be brought into engagement with the projection to prevent an inadvertent pivotal upward movement of the step when the step tends to inadvertently move upwardly in pivotal motion.

Figure 1:
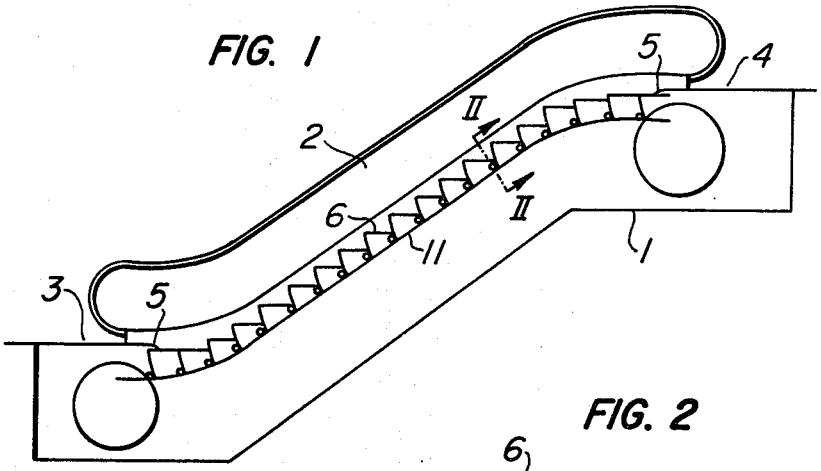
FIG. 1 is a schematic side view of an escalator showing the manner in which the steps thereof travel during operation.

Before describing the invention in detail, an escalator in use nowadays will be outlined. As is well known, an escalator is provided between a floor of a lower level and a floor of a higher level and serves as a moving stairway. It comprises a frame 1 supporting the entire structure, a pair of railings 2, a lower end portion 3 which may serve as either an entrance or an exit for passengers, an upper end portion 4 which may serve either as an exit or an entrance for passengers, comb plates 5 each disposed at the lower end portion 3 or the upper end portion 4 for scooping up the passengers and a number of treads 6 of the steps linked in an endless belt and traveling in a loop for carrying the passengers.

This invention provides, in a known escalator of the aforementioned construction, means for preventing an inadvertent pivotal upward movement of one of the steps on which a passenger stands. A preferred embodiment thereof will be described with reference to FIG. 2 and FIG. 3.

Figure 2:
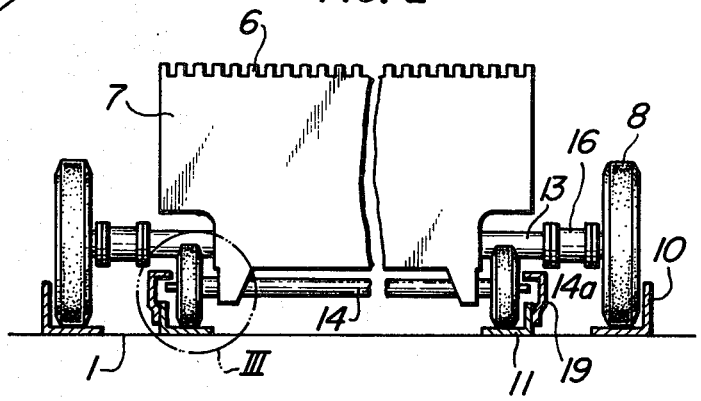
FIG. 2 is a sectional view taken along the line II—II of FIG. 1, showing the front of a step incorporating this invention therein.
Figure 3:
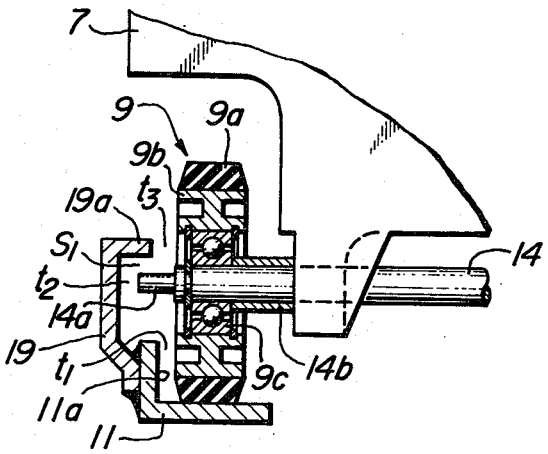
FIG. 3 is a fragmentary enlarged view of a portion surrounded by a phantom line III in FIG. 2.

In FIG. 2 and FIG. 3, each of the steps 6 includes a rear shaft 14 which has projections 14a extending axially from opposite ends thereof and outwardly of rear wheels 9. A pair of upthrust rails 19 are each affixed as by welding to one of a pair of rear wheel guide rails 11. Each upthrust rail 19 includes a flange 19a extending inwardly and disposed above one of the projections 14a, the spacing between the flange 19a and the projection 14a having a value designated by $S_1$. Each projection 14a has a length such that its outer end does not extend outwardly of a side edge of a riser 7. Each projection 14a is spaced from a vertical portion of each projection upthrust rail 19 by a distance $t_2$, an outer side of each rear wheel 9 is spaced from an outer end of the flange 19a of each projection upthrust rail 19 by a distance $t_3$, and an outer side of each rear wheel 9 is spaced from a flange 11a of one of the pair of rear wheel guide rails 11 by a distance $t_1$. The distances $t_2$ and $t_3$ are greater than the distance $t_1$. The numeral 9a designates rubber tires. The numeral 9b designates hubs of the rear wheels 9. The numeral 9c designates bearings.

The aforementioned embodiment of the invention can achieve the following effects:

(1) There is a great spacing between the projections 14a of the rear shaft 14 and a front shaft 13 of each step 6 even in a section of the escalator in which the rear wheel guide rails 11 as well as front wheel guide rails 10 are linear. This permits the projection upthrust rails 19 to be mounted in the entire section of the escalator in which the front and rear wheel guide rails 10 and 11 are curved and also in sections disposed both anterior and posterior to the curved front and rear wheel guide rail sections. By this arrangement, it is possible to prevent an inadvertent pivotal upward movement of the riser 7 portion of the step in the entire region of the escalator in which the accident of shoes or other objects being caught in a riser 7 tends to occur.

(2) The rear shaft 14 of each step 6 is positioned with a high degree of precision such that there is little or no variation in the position of the rear shaft 14 from one step to another, with the result that an inadvertent pivotal upward movement of any of the steps 6 can be prevented by the projections 14a extending axially of the rear shaft 14. This enables the spacing $S_1$ between the flange 19a of each projection upthrust rail 19 and one of the projections 14a of the rear shaft 14 to be minimized such that an inadvertent pivotal upward movement of the step 6 can be minimized even if this phenomenon occurs. This substantially eliminates the occurrence of an accident in which shoes or other objects are caught in the riser 7 of the step 6.

(3) The device provided by the invention is very simple in construction, because it comprises projections 14a extending from the rear shafts 14 and the projection upthrust rails 19. The device provided by the invention is economically acceptable because it requires a smaller number of parts than a device of the prior art using pawl means and easier to fabricate and assemble.

(4) In the event that one of the rear wheels 9 of any one of the steps 6 or any one of the rubber tires 9a is dislodged from its position and the step 6 is inclined, no damage can be done to the step 6 because there is nothing against which the projection strikes.

(5) Since the projections 14a do not extend outwardly of the side edges of each riser 7, there is no difficulty encountered in assembling the steps 6 to provide an escalator. Even if the steps 6 are made to be positioned sideways, no damage can be done to the projections by striking them.

(6) Even if the steps 6 move in zigzag motion during their travel, the rear wheels 9 are brought into engagement with the flanges 11a of the rear wheel guide rails 11 by moving through the distance $t_1$, thereby guiding the movement of the rear wheels 9. By this arrangement, any damage to the projections 14a or projection upthrust rails 19 can be prevented.

(7) The arrangement in which the rear wheel guide rails 11 and the projection upthrust rails 19 are disposed in adjacent relationship enables the dimensional relationship thereof to be positively and readily determined as desired by directly joining them by welding. At the same time, one of them can serve as a reinforcing member for the other, thereby increasing the rigidity of the entire structure.

FIG. 4 to FIG. 9 show various modifications of the embodiment shown in FIG. 2. These modifications will be described by referring to the drawings.

Figure 4:
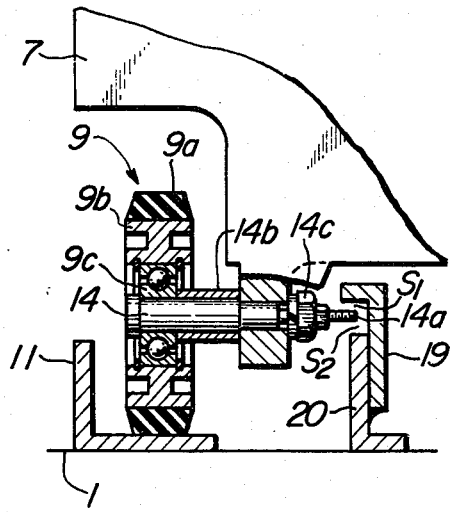
FIG. 4 to FIG. 9 are fragmentary enlarged views similar to FIG. 2 and showing modifications of the embodiment of the invention shown in FIG. 2.

Referring to FIG. 4, there is shown a modification of the embodiment shown in FIG. 2 in which the projections 14a are each mounted on an end of rear shaft 14 opposite to the end thereof at which one of the rear wheels 9 is mounted, in an escalator of the type in which each of the steps 6 includes a plurality of rear shafts 14 instead of one rear shaft 14. Each projection 14a is disposed above a base 20 so that this modification of the embodiment has the added effect of preventing an inordinate inclination of any one of the steps 6 by the combination of the projection 14a with the base 20, in the event that any one of the rear wheels 9 is dislodged from its position.

More specifically, the base 20 is located below each projection 14a and spaced therefrom by a distance $S_2$. By this arrangement, when any one of the rear wheels 9 or rubber tires 9a is dislodged from its position, the projection 14a is brought into engagement with the base 20, thereby preventing an inordinate inclination of the step 6 and enabling the passengers to safely get on and off the escalator. It is possible to enable the passengers to safety get on and off the escalator if the spacing $S_2$ between the projection 14a and the base 20 is set at a level such that depressed areas on the surface of each step 6 are in meshing engagement with teeth of the comb plate 5 in the lower and upper ends 3 and 4 of the escalator or preferably in meshing engagement therewith to an extent of over 2 millimeters.

Figure 5:
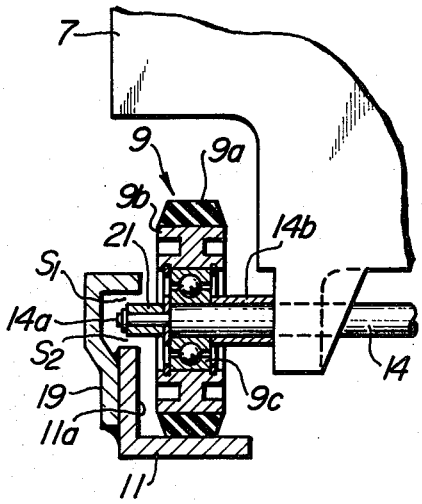

FIG. 5 shows a modification of the embodiment shown in FIG. 2 in which a roller 21 is mounted on each of the projections 14a for rotation independently of the rear wheels 9. By providing the roller 21 to each of the projections 14a, it is possible to achieve the added effect of preventing damage to the projections 14a and the projection upthrust rails 19, when any one of the steps inadvertently moves in pivotal upward movement and the projection 14a is brought into contact with the cooperating projection upthrust rail 19, or when any one of the rear wheels 9 is dislodged from its position and the projection 14a is brought into contact with an upper surface of the flange 11a of the rear wheel guide rail 11, because the roller 21 rotates and biting of one into the other can be prevented.

Figure 6:
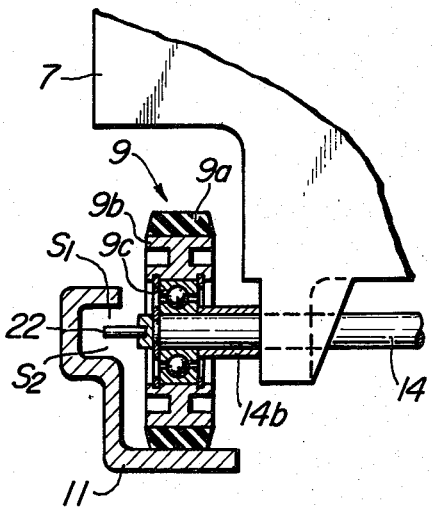

In FIG. 6, there is shown a modification in which a pin 22 is threaded into or force fitted into the center of each end of the rear shaft 14 so that the pin 22 can be utilized in the same manner as the projection 14a. The use of the pin 22 offers many advantages. If the pin 22 is bent or broken by some reason, the step 6 itself can be used by replacing the damaged pin 22 by a new one. On the other hand, if the pins 22 are removed, the steps 6 can be utilized for use with an escalator of the rear wheel upthrust system which is in actual use, thereby permitting the steps 6 to be interchangeable for service between the two different systems of escalators.

In the present invention, each projection upthrust rail 19 is disposed adjacent one of the rear wheel guide rails 11. Therefore, as shown in FIG. 6, the two members can be formed integrally by bending a single steel plate. This can achieve the effects of improving the relative dimensions of the two members and fabricating them at low cost.

In the embodiment of the invention and its modifications shown and described hereinabove, the projections 14*a* have a slightly smaller outer diameter than the rear shaft 14 so as to increase the distance between the projections 14*a* and the front shaft 13. It is to be understood that the same effect can be achieved by cutting the projections 14*a* so that the projections may be in semicircular shape and by mounting the projection upthrust rails 19 in such a manner that the flanges of the rails 19 are disposed above the cutout portions of the projections 14*a*.

In the embodiment of the invention and its modifications described hereinabove, the device for preventing an inadvertent pivotal upward movement of any one of the steps 6 comprises the projections 14*a* of the rear shaft 14 which is nonrotatable and the projection upthrust rails 19 adapted to be brought into contact with the respective projections 14*a*. The same effect can be achieved by using a device which comprises projections 23*a* attached to ends of the rear wheels 9 which rotate and the projection upthrust rails 19 as shown in FIG. 7 to FIG. 9.

Figure 7:
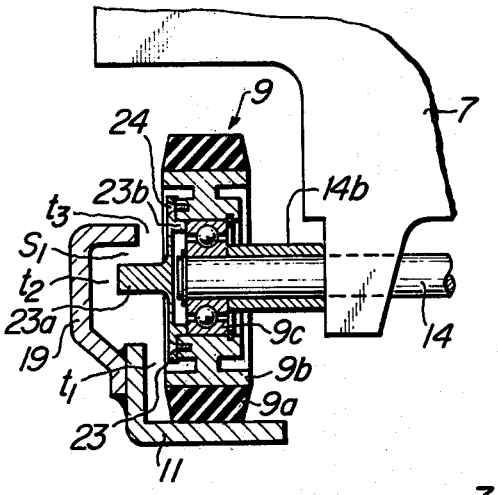

Referring to FIG. 7, a projecting member 23 having a projection 23*a* is secured by means of a screw 24 to one side of a hub 9*b* of the rear wheel 9. The projecting member 23 includes a guide portion 23*b* which is concentric with the projection 23*a* and fitted in a portion of the rear wheel hub 9*b* in which the bearing 9*c* is fitted, so that the guide portion 23*b* concurrently performs the function of holding the bearing 9*c* in place. In a modification shown in FIG. 8, the projecting member 23 is produced by means of a press.

Figure 8:
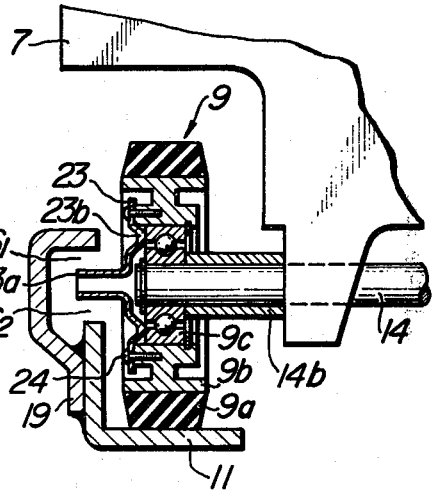

In the modifications shown in FIG. 7 and FIG. 8, each rear wheel 9 mounts at one side thereof the projecting member 23 having the projection 23*a*. In the arrangement described, when the step 6 inadvertently moves in pivotal upward movement and the projection 23*a* is brought into contact with the cooperating projection upthrust rail 19, no wear or damage is caused on the projections 23*a* and the rail 19 because the projecting member 23 rotates. Moreover, since the guide portion 23*b* of the projecting member 23 is fitted in the machined portion of the rear wheel hub 9*b*, the projection 23*a* is kept from rotating in eccentric motion, since the projecting member 23 is mounted in the rear wheel 9 with a high degree of precision.

Figure 9:
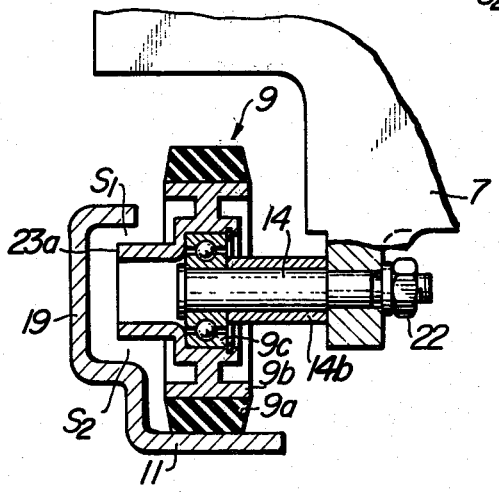

In FIG. 9, there is shown a modification in which the projecting member 23 is mounted in the rear wheel 9 supported by the rear shaft 14 which supports only one rear wheel 9 because the rear shaft of each step 6 is divided into two shaft portions each supporting one of the rear wheels. This modification is economically acceptable because the number of parts is reduced and machining and assembling of parts can be performed readily, since the projecting member 23 is formed integrally with the rear wheel hub 9*b*. However, this modification has a disadvantage in that it is impossible to reduce the outer diameter of the projection 23*a* as compared with the rear shafts 14. Because of this, there is no great spacing between the projection upthrust rails 19 and the front shaft 13 of each of the steps 6 if the front and rear wheel guide rails 10 and 11 become linear in a type of escalators in general use in which the rolling surfaces of the front and rear wheel guide rails 10 and 11 are substantially horizontal in their linear portions. This makes it difficult to make the projection upthrust rails 19 extend as far as the portions of the escalator in which the front and rear wheel guide rails 10 and 11 are linear. However, the present invention is more effective than the system of the prior art in which the rear wheel upthrust rails are provided above the rear wheels. In the present invention, it is possible to make the projection upthrust rails 19 extend substantially through the entire range of the curved portion of the rear wheel guide rails, so that an inadvertent pivotal upward movement of any one of the steps can be prevented in all the portion of the escalator in which the difference in height between the surfaces of the adjacent steps decreases.

In the embodiment shown in FIG. 3 and the modifications thereof shown in FIG. 4 to FIG. 9, the invention has been described with reference to the prevention of an accident at the upper curved sections of the front and rear wheel guide rails 10 and 11 at the time the steps 6 are operated to move in an ascending movement when the escalator is moved from the lower floor to the upper floor. It is to be understood that the same effect can be achieved with respect to the prevention of an accident at the lower curved sections of the front and rear wheel guide rails 10 and 11 at the time the steps are operated to move in a desending movement when the escalator is moved from an upper floor to a lower floor.

Experiments have been carried out on the embodiment and all the variations thereof to see if an inadvertent pivotal upward movement of the steps can be prevented and the accident of shoes or other objects being caught in the riser of a step can be avoided in substantially all the sections of an escalator in which a change occurs in the height between the surfaces of the treads of the adjacent steps. In carrying out the experiments, various types of shoes including those made of a soft material, a hard material and other materials which differ from one another in pressing force were used with varying degrees of a gap between the riser 7 of the preceding step 6 and the tread of the following step 6 and by varying the size of the spacing $S_1$ between the projections 14*a* or 23*a* and the flanges 19*a* of the projection upthrust rails 19. As the result of the experiments, it has been ascertained that, by limiting the spacing $S_1$ to a level below 3 millimeters, it is possible to substantially eliminate accidents involving the shoes being caught in the riser portion of a step of escalators of the type now being in actual operation. It has also been ascertained that the spacing $S_1$ is preferably smaller than 2 millimeters to cope with the situation in which the shoes or other objects involved in an accident are made of a soft material and the passenger behaves in a manner such that he is most likely to expose himself to danger.

In order that the device for preventing an inadvertent pivotal upward movement of the treads of the steps as described with reference to the embodiment of the invention and the variations thereof can achieve excellent results, it is desirable that the projection upthrust rails 19 adapted to come into engagement with the projections 14*a* or 23*a* be mounted in substantially all the section of the escalator in which the rear wheel guide rails 11 are curved, and that the spacing $S_1$ be set at a level below 3 millimeters. If these can be realized, the invention offers the advantage of being able to prevent substantially all the accidents involving shoes or other objects being caught in the riser portion of a step.

It is to be noted that, although it is desirable to minimize the amount of an inadvertent pivotal upward movement of the steps, there will arise the problem of the projections 14*a* or 23*a* being brought into engagement with the projection upthrust rails 19 and producing an abnormal noise, if the amount is too small. Thus it is necessary that the spacing $S_1$ be about 0.2 millimeter in the minimum.

To sum up, this invention provides projections which axially extend from opposite ends of the rear shaft of a step in the rear wheel portion of the step, and upthrust rails formed with flanges adapted to come into engagement with the projections when the tread of the step tends to move in inadvertent pivotal upward movement. The invention is effective to prevent an inadvertent pivotal upward movement of the steps with a high degree of accuracy in all the section of the escalator in which the difference in height between the surfaces of the treads of the adjacent steps decreases. Thus, the invention can offer the advantage of avoiding an accident in which shoes or other objects are caught in the riser portion of a step and hence of preventing injury to the passengers of the escalator.

What we claim is:

1. An escalator comprising:

steps connected with each other in an endless fashion;

front wheels and rear wheels rotatably supported by each of said steps through a front shaft and a rear shaft, respectively;

a first pair of guide rails on which said front wheels roll, and a second pair of guide rails on which said rear wheels roll;

projections extending coaxially outwardly from the ends of said rear shaft; and a pair of upthrust rails disposed in a juxtaposed relation to said projections and adapted to engage with said projections, upon the upward pivotal movement of the step, to prevent the further upward pivotal movement of the step, wherein each of said second pair of guide rails includes a horizontal section defining a rolling surface for said rear wheel, and a vertical section on the edge of said horizontal section at the side where said projection is located, and wherein each of said pair of upthrust rails includes a horizontal section disposed above said projection, and wherein a clearance between the tip of the projection and the vertical section of said upthrust rail and a clearance between the rear wheel and the edge of the horizontal section of said upthrust rail are greater than that between the rear wheel and the vertical section of said second guide rail, whereby damage to said projection and upthrust rail can be prevented upon lateral shifting of said steps.

2. An escalator according to claim 1, wherein the projections do not protrude beyond the side edges of the step.

3. An escalator according to claim 1, wherein said projections each have means for preventing the projection from biting into the upthrust rail upon upward pivotal movement of a step comprising a roller mounted about said projection so as to be rotatable independent of said wheels.

4. An escalator according to claim 1, wherein each of said projections has an outer diameter at most equal to that of the minimum outer diameter of the rear shaft.

5. An escalator according to claim 2, wherein each of said projections has an outer diameter at most equal to that of the minimum outer diameter of the rear shaft.

6. An escalator as claimed in claim 1, further comprising means located below said projections for preventing inadvertent pivotal downward movement of any of said steps when the rear wheels of the step are dislodged from their positions.

7. An escalator as claimed in claim 1, wherein said projections rotate with the rear wheels as a unit.

8. An escalator as claimed in claim 1, wherein each of said projections has a guide portion fitted in an inner peripheral surface of a hub of each of said rear wheels.

9. An escalator as claimed in claim 1, wherein each of said upthrust rails is formed integrally with one of the rear wheel guide rails.

* * * * *